US010203113B2

(12) United States Patent
Yang

(10) Patent No.: US 10,203,113 B2
(45) Date of Patent: Feb. 12, 2019

(54) AUTOMATIC CANDLE SNUFFER

(71) Applicant: Min Moc Yang, Seoul (KR)

(72) Inventor: Min Moc Yang, Seoul (KR)

( * ) Notice: Subject to any disclaimer, the term of this patent is extended or adjusted under 35 U.S.C. 154(b) by 204 days.

(21) Appl. No.: 15/417,814

(22) Filed: Jan. 27, 2017

(65) Prior Publication Data

US 2017/0276354 A1 Sep. 28, 2017

(30) Foreign Application Priority Data

Mar. 26, 2016 (KR) ..... 10-2016-0036412
Sep. 9, 2016 (KR) ..... 20-2016-0005342 U

(51) Int. Cl.
*F21V 35/00* (2006.01)
*F23Q 25/00* (2006.01)

(52) U.S. Cl.
CPC ..... *F23Q 25/00* (2013.01); *F21V 35/00* (2013.01)

(58) Field of Classification Search
CPC ..... F21V 35/00; F23Q 25/00
USPC ..... 431/33, 35, 144
See application file for complete search history.

(56) References Cited

U.S. PATENT DOCUMENTS 4,138,211 A * 2/1979 Kampfer ..... F23Q 25/00 431/35
D310,127 S * 8/1990 Johnsson ..... D26/23
2003/0134242 A1* 7/2003 Hart ..... F21V 35/00 431/33
2007/0031769 A1* 2/2007 Burton ..... F23Q 25/00 431/144
2007/0128561 A1* 6/2007 Hart ..... F23D 3/16 431/33
2010/0075265 A1* 3/2010 Quinn ..... F23D 3/16 431/289
2014/0134552 A1* 5/2014 Trevino ..... F23Q 25/00 431/152
2015/0104749 A1* 4/2015 Billy ..... F21V 35/00 431/2

FOREIGN PATENT DOCUMENTS

KR 2002243910000 3/2001
KR 20100096634 9/2010

* cited by examiner

*Primary Examiner* — Avinash Savani
(74) *Attorney, Agent, or Firm* — IPLA P.A.; James E. Bame

(57) ABSTRACT

Provided is an automatic candle snuffer. The snuffer includes a holder having a penetrating part to be seated on a top opening of a candle housing according to an outer circumference size of the candle housing, a cover coupled via a hinged coupling part to limit the supply of oxygen by closing the penetrating part of the holder, and a rotary lid rotatably coupled to an upper end of the cover. The automatic candle snuffer is capable of automatically extinguishing a candle when a predetermined time has passed after the candle is lit.

4 Claims, 4 Drawing Sheets

AUTOMATIC CANDLE SNUFFER

CROSS REFERENCE

This application claims priority of Korean Patent Application No. 20-2016-0005342 filed 9 Sep. 2016, and 10-2016-0036412 filed 26 Mar. 2016, each with the Korean Intellectual Property Office, each of which is hereby incorporated by reference in its entirety.

BACKGROUND

The present invention relates to automatic candle snuffers, and more particularly, to an automatic candle snuffer, which is capable of automatically extinguishing a candle when a predetermined time has passed after the candle is lit.

A candle is an article that is produced by sticking a wick made of a fibrous material in a combustible material. Recently, the candle is widely used as an ornament or air freshener. However, if the candle falls down or is left unattended for a long time after a user lights the candle, there is the risk of fire. In order to solve the problem, a plurality of candles having an automatic candle snuffer or a safety device therein have been developed and utilized. Korean Patent Application No. 10-2009-0015596 provides a safety candle, which has high stability to prevent it from falling down or to shut out the wind surrounding flame and is automatically extinguished, due to a fire-retardant wick stand provided on a lower end thereof and an incombustible material, after the candle is lit. Therefore, this guarantees safety even if the candle is left unattended as it is lit. Further, Korean Utility Model Patent Application No. 20-2000-0034600 provides a candle holder, which may maintain candlelight without being affected by the wind, may guarantee convenience for mounting the candle, and may reduce the risk of fire. The candle holder includes a water receiving part and a windscreen part. The water receiving part is a cylindrical body that is closed at a bottom thereof and open at a top thereof. A support part is formed on a lower end thereof, and a protrusion-shaped candle holding part protruding upwards is provided on a center of the support part, and a plurality of water supply holes are formed through an outer circumference of the support part to be at a certain height thereof, and a threaded part is formed along a circumference of an uppermost end of the support part. The windscreen part is open at both a bottom and a top thereof, and a thread fastening part is formed along a circumference of a lowermost end thereof, and a diameter of an upper end thereof is gradually reduced in a direction from a lower position to an upper position, thus defining a ventilation part. This is advantageous in that it is convenient to hold the candle, the risk of fire is reduced, the candlelight is adequately maintained and the damage caused by candle drippings is prevented without external influences. However, this has no timer function to limit the combustion time of the candle. Thereby, the present invention provides an automatic candle snuffer, which limits the supply of oxygen required to burn the candle by closing a candle housing, using the rotating force of a spring, thus allowing the candle to be automatically extinguished while the candle is burned.

SUMMARY OF THE INVENTION

Accordingly, the present invention has been made keeping in mind the above problems occurring in the related art, and an aspect of the present invention is directed to provide an automatic candle snuffer having a closing means, which is configured to limit the supply of oxygen to a candle being lit when a predetermined time has passed after the candle is ignited, thus allowing the lit candle to be automatically extinguished.

In order to accomplish the object, the present invention provides an automatic candle snuffer including a holder that may be seated on a candle housing; a cover that may close an opening of the candle housing; and a hinged coupling part that may couple the holder with the cover.

Further, the present invention provides an automatic candle snuffer, which is configured to drop a cover coupled with a holder via a hinged coupling part if a predetermined combustion time has passed, using a spring accommodated in the cover, and then close an opening of a candle housing in which a candle is burned or a penetrating part of the holder, thus limiting the supply of oxygen.

BRIEF DESCRIPTION OF THE DRAWINGS

The above and other aspects, features and advantages of certain exemplary embodiments of the present invention will be more apparent from the following description taken in conjunction with the accompanying drawings, in which.

DETAILED DESCRIPTION OF THE INVENTION

Figure 1:
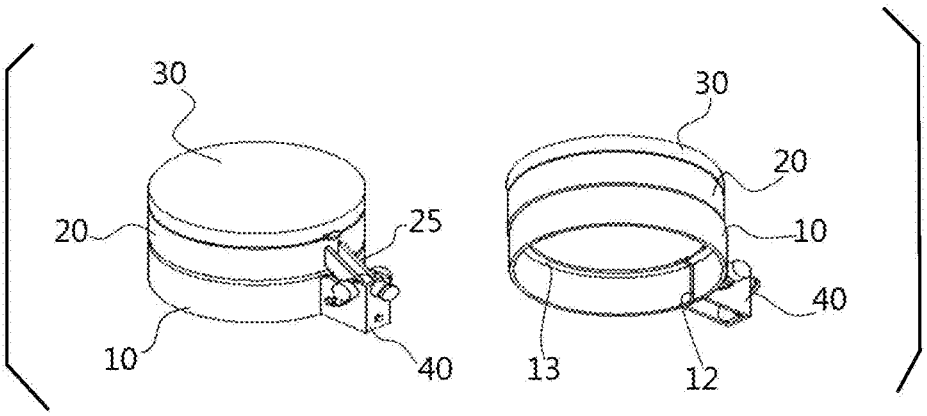
FIG. 1 is a perspective view illustrating an automatic candle snuffer.
Figure 2:
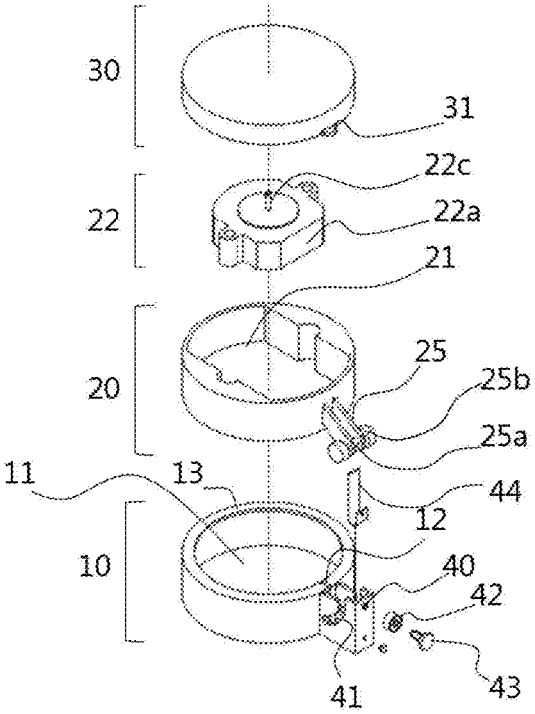
FIG. 2 is an exploded perspective view illustrating the automatic candle snuffer.
Figure 3:
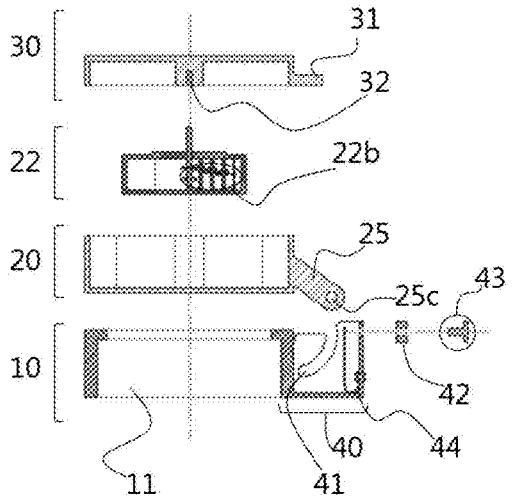
FIG. 3 is an exploded sectional view illustrating the automatic candle snuffer.
Figure 4:
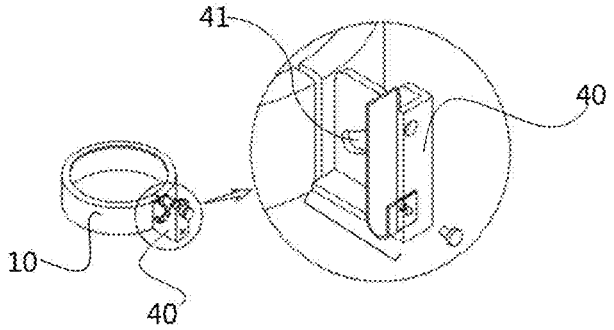
FIG. 4 is a detailed view illustrating a coupling part of the automatic candle snuffer.
Figure 5:
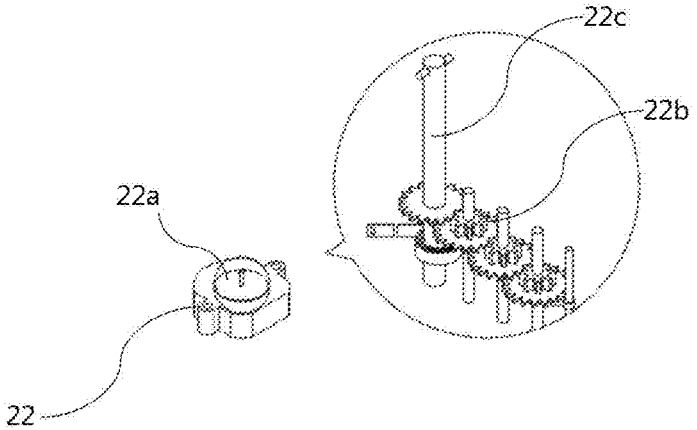
FIG. 5 is a detailed view illustrating a spring of the automatic candle snuffer.

Exemplary embodiments of the present invention will be described below in detail with reference to the accompanying drawings.

Unless defined otherwise, all the terms used in this specification including technical and scientific terms have the same meanings as would be generally understood by those skilled in the related art. The terms defined in generally used dictionaries should be construed as having the same meanings as would be construed in the context of the related art, and unless clearly defined otherwise in this specification, should not be construed as having idealistic or overly formal meanings.

The present invention is directed to an automatic candle snuffer. The automatic candle snuffer includes a holder 10 having a penetrating part 11 to be seated on a top opening 51 of a candle housing 50 according to an outer circumference size of the candle housing 50, a cover 20 coupled via a hinged coupling part 40 to limit the supply of oxygen by closing the penetrating part of the holder, and a rotary lid 30 rotatably coupled to an upper end of the cover.

Figure 9:
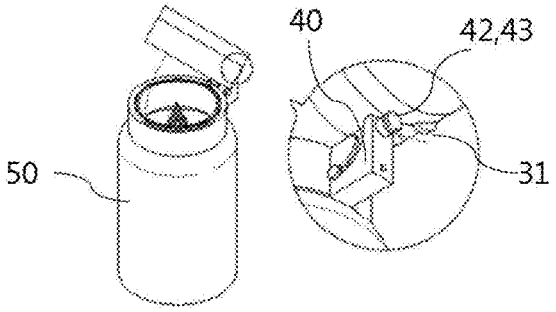
FIG. 9 is a detailed view implementing the coupling part of the automatic candle snuffer.

To be more specific, as illustrated in FIG. 9, the candle housing 50 is made such that the top opening 51 provided on an upper portion thereof is smaller in outer diameter than a wax reservoir 53 provided on a lower portion thereof to store wax therein, thus defining a locking part 52 between the top opening and the wax reservoir.

Figure 6:
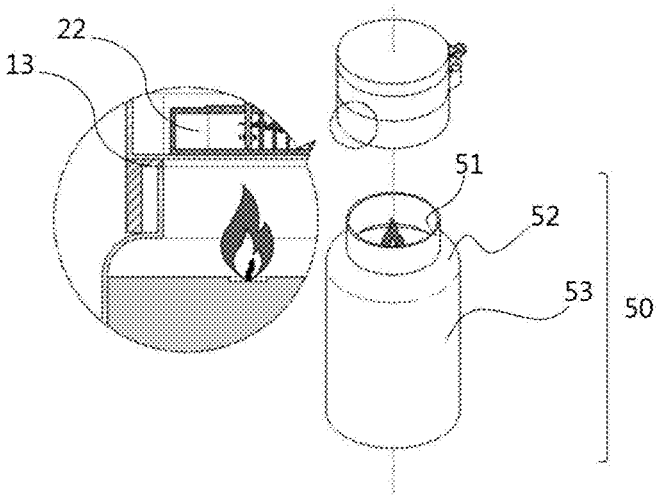
FIG. 6 is a detailed assembly view illustrating the automatic candle snuffer.
Figure 7:
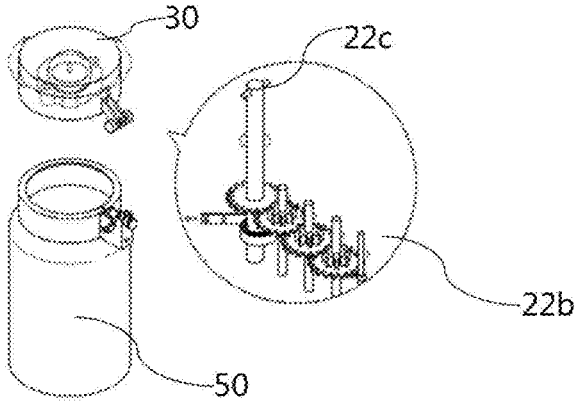
FIG. 7 is a view illustrating the interior of the spring of the automatic candle snuffer.
Figure 8:
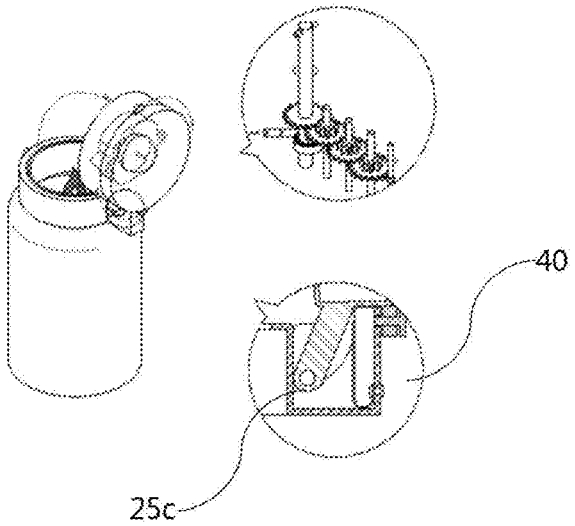
FIG. 8 is a detailed view implementing the coupling part of the automatic candle snuffer.

The holder 10 may be made in a polygonal or cylindrical shape to conform to the shape of the candle housing, and thereby may be seated on the locking part 52 that is naturally formed by a difference in outer diameter between the top opening 51 and the wax reservoir 53 of the candle housing. The penetrating part 11 is formed through the holder to allow it to be seated on the locking part 52 through the top opening 51. A separating part 12 is formed to be open at a side of the holder, thus allowing the holder to be enlarged depending on the outer diameter of the candle housing. Moreover, a locking step 13 is formed on an upper surface of the holder to allow it to engage with the top opening of the candle housing, as illustrated in FIG. 6.

The cover 20 made in a polygonal or cylindrical shape to conform to the shape of the holder includes a hollow accommodating part 21, two plate-shaped inserting parts 25 that are attached to an outer wall of the cover to be spaced apart from each other by a predetermined interval, with a coupling hole 25*c* formed in one end of each inserting part, a rod 25*a* inserted into the coupling holes 25*c*, and wheels 25*b* coupled to both ends of the rod.

The coupling part 40 is made in a "U" shape, and coupled with the outer wall of the holder with the separating part 12 therebetween, as illustrated in FIG. 1. The coupling part 40 includes an open rod rail 41, a plate spring 44, and an arm locking part 42. The open rod rail 41 is formed such that the inserting part 25 of the cover 20 and the rod 25*a* equipped with the wheels 25*b* are seated therein, thus opening or closing the cover 20 in a hinged manner. The plate spring 44 is fastened to an inner wall of a central portion of the coupling part. The arm locking part 42 is fastened to an outer wall of an upper end of the coupling part using a fastening pin.

A spring is installed in the accommodating part 21 of the cover, and includes a spring case 22*a* in which a spring driving part 22*b* is accommodated, and a rotary actuating part 22*c* that is rotatably exposed to a top of the spring case 22*a*.

The rotary lid 30 is rotatably mounted on an upper surface of the cover, and includes an operable locking part 32 that is formed on a lower surface of the rotary lid and is fixedly coupled thereto to operate the rotary actuating part 22*c* of the spring, and an operating arm 31 that is integrally formed on a side of the rotary lid. That is, the rotary actuating part is assembled with the operable locking part 32 that is formed on the lower surface of the rotary lid 30. If the rotary lid is rotated, the spring 22 may be wound. The wound spring may be unwound as a predetermined time has passed while the rotary lid is rotated. Since it is apparent that a spring operating method may be derived from the related art, this will not be described herein.

According to an embodiment, the present invention relates to an automatic candle snuffer. This is coupled to the candle housing 50 via the holder 10, and the cover is coupled to the holder 10 using the hinged coupling part 40 or the inserting part 25 of the cover, thus opening or closing the penetrating part 11 of the holder or the top opening 51 of the candle housing. That is, the holder 10 may be seated on the upper end of the candle housing using the locking step 13 of the holder or the locking part 52 of the candle housing. By vertically lifting the cover 20 to which the rotary lid 30 is rotatably coupled using the hinged coupling part 40, the penetrating part of the holder or the top opening 51 of the candle housing may be opened, and the rotary lid and the cover that are vertically lifted are held on the upper surfaces of the holder and the coupling part, thus keeping the top opening open.

Figure 10:
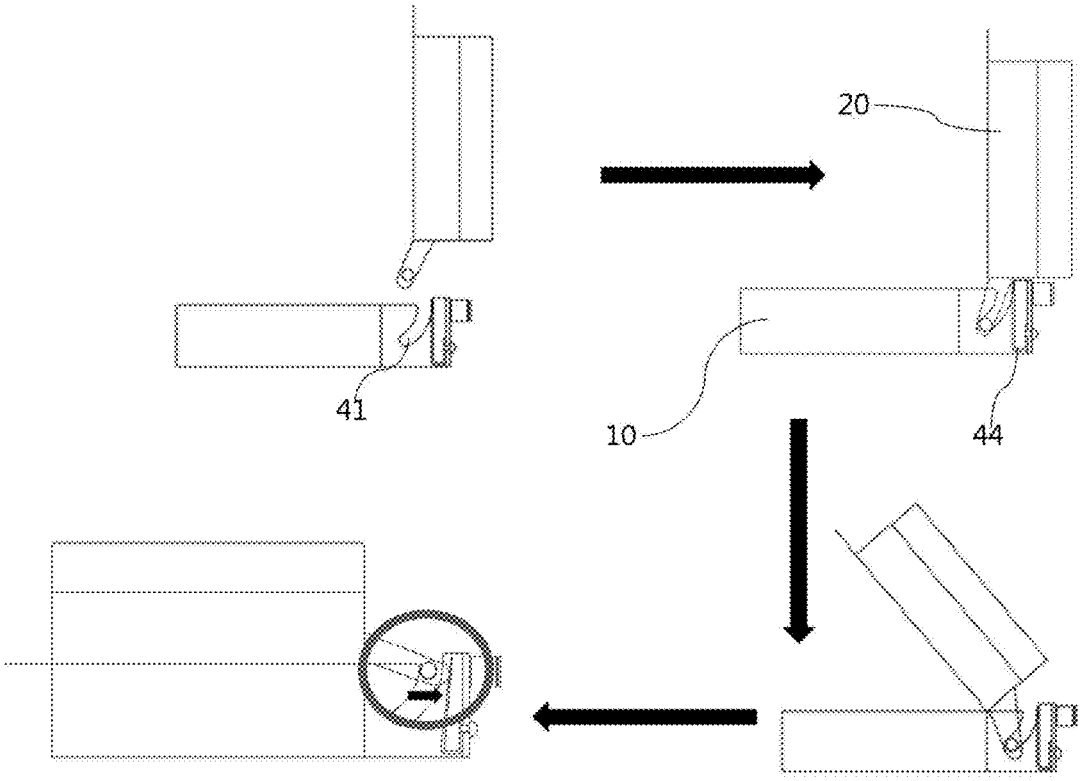
FIG. 10 is a detailed view illustrating a plate spring of the automatic candle snuffer.

Further, if the rotary lid rotatably coupled to the cover is rotated in one direction, the rotary actuating part 22*c* of the spring accommodated in the accommodating part of the cover is rotated, thus causing the spring to be wound. By operating the spring driving part 22*b* for a predetermined time using the rotating force of the spring, the rotary lid 30 coupled with the rotary actuating part may be rotated in one direction. Thereby, this serves as a timer. In other words, when the rotary lid is rotated to wind the spring, the cover 20 coupled with the rotary lid 30 is lifted to open the top opening, and then the candle is lit, the operating arm 31 formed on the rotary lid is rotated, so that the cover may be pushed forwards as illustrated in FIG. 9, using the arm locking part 42 coupled to the outer wall of the upper end of the coupling part by the fastening pin 43. As the rotary lid and the cover that open the top opening of the candle housing integrally drop, the top opening of the candle housing is closed, thus preventing oxygen from being supplied and allowing the candle to be automatically extinguished when a predetermined time has passed after the candle is lit. However, in order to reduce the rapid drop velocity of the cover 20 due to the gravity, the plate spring 44 is installed in a central portion of the coupling part 40. Since the cover drops while the inserting part attached to the cover inwardly pushes the plate spring installed in the coupling part as illustrated in FIG. 10, it is possible to significantly reduce the drop velocity and consequently to mitigate shocks transmitted to the holder or the candle housing.

As described above, the present invention provides an automatic candle snuffer, which is automatically extinguished when a predetermined combustion time has passed without the necessity of checking a lighting time, thus being capable of reducing an unnecessary wasted combustion time.

While the invention has been shown and described with reference to exemplary embodiments thereof, it will be understood by those skilled in the art that various changes in form and details may be made therein without departing from the spirit and scope of the invention as defined by the appended claims.

Therefore, it is to be understood that the scope of the invention is not limited to the above-described embodiments, and all changes that fall within meets and bounds of the claims, or equivalence of such meets and bounds are intended to be embraced by the claims.

What is claimed is:

1. An automatic candle snuffer coupled to a candle housing including a top opening, a wax reservoir, and a locking part defined between the top opening and the wax reservoir, the automatic candle snuffer comprising:

a holder having a penetrating part to be seated on the top opening of the candle housing according to an outer circumference size of the candle housing;

a "U"-shaped hinged coupling part attached to an outer wall of the holder, with a rod rail being formed through a sidewall of the coupling part;

a cover coupled via the coupling part to limit supply of oxygen by closing the penetrating part of the holder, thus opening or closing the top opening of the candle housing or an upper end of the penetrating part of the holder;

an inserting part attached to the cover, with a coupling hole formed in one end of the inserting part, the inserting part including a rod inserted into the coupling hole, and wheels coupled to both ends of the rod;

a rotary lid rotatably coupled to an upper end of the cover, and a locking step formed on an upper surface of the holder to allow it to engage with the top opening of the candle housing, whereby the rod of the inserting part is inserted along the rod rail of the coupling part to open or close the cover, and the cover and the rotary lid are vertically held on the holder to maintain an open state.

2. The automatic candle snuffer of claim 1, wherein the cover comprises:

an accommodating part formed therein;

a spring provided in the accommodating part, and including a spring driving part, a spring case in which the spring driving part is accommodated, and a rotary actuating part that passes through the spring case to protrude out therefrom, thus actuating the spring driving part;

an operable locking part formed on a lower surface of the rotary lid to be coupled to the rotary actuating part;

an operating arm integrally formed on an outer wall of a side of the rotary lid; and an arm locking part coupled to an outer wall of an upper end of the coupling part via a fastening pin, whereby the spring is wound by rotating the rotary lid, and the rotary lid is rotated while the spring is unwound in a state where the cover and the rotary lid are lifted up, so that the operating arm pushes the arm locking part of the coupling part and thereby the cover is dropped, thus closing the top opening and extinguishing the candle that is being burned.

3. The automatic candle snuffer of claim 2, further comprising:

a plate spring coupled to an inner wall of a central portion of the coupling part, whereby the cover drops while the inserting part attached to the cover inwardly pushes the plate spring installed in the coupling part, thus significantly reducing a drop velocity and consequently mitigating shocks transmitted to the holder or the candle housing.

4. An automatic candle snuffer coupled to a candle housing including a top opening, a wax reservoir, and a locking part defined between the top opening and the wax reservoir, the automatic candle snuffer comprising:

a holder having a penetrating part to be seated on the top opening of the candle housing according to an outer circumference size of the candle housing;

a "U"-shaped hinged coupling part attached to an outer wall of the holder, with a rod rail being formed through a sidewall of the coupling part;

a cover coupled via the coupling part to limit supply of oxygen by closing the penetrating part of the holder, thus opening or closing the top opening of the candle housing or an upper end of the penetrating part of the holder;

an inserting part attached to the cover, with a coupling hole formed in one end of the inserting part, the inserting part including a rod inserted into the coupling hole, and wheels coupled to both ends of the rod;

a rotary lid rotatably coupled to an upper end of the cover; and a separating part formed to be open at a side of the holder, whereby the rod of the inserting part is inserted along the rod rail of the coupling part to open or close the cover, and the cover and the rotary lid are vertically held on the holder to maintain an open state.

* * * * *